US008720286B2

(12) United States Patent
Edwards et al.

(10) Patent No.: US 8,720,286 B2
(45) Date of Patent: May 13, 2014

(54) TEMPERATURE INSENSITIVE DEVICES AND METHODS FOR MAKING SAME

(75) Inventors: Carl M. Edwards, Katy, TX (US); Dustin Carr, Albuquerque, NM (US)

(73) Assignee: Baker Hughes Incorporated, Houston, TX (US)

( * ) Notice: Subject to any disclaimer, the term of this patent is extended or adjusted under 35 U.S.C. 154(b) by 218 days.

(21) Appl. No.: 12/939,280

(22) Filed: Nov. 4, 2010

(65) Prior Publication Data

US 2011/0107852 A1 May 12, 2011

Related U.S. Application Data

(60) Provisional application No. 61/258,895, filed on Nov. 6, 2009.

(51) Int. Cl.
*G01L 1/08* (2006.01)

(52) U.S. Cl.
USPC ..... 73/862.61

(58) Field of Classification Search
USPC ..... 73/862.61, 862.21
See application file for complete search history.

(56) References Cited

U.S. PATENT DOCUMENTS

| | | | | |
|---|---|---|---|---|
| 1,393,828 | A | 10/1921 | Reichmann | |
| 1,899,436 | A * | 2/1933 | Fletcher | 177/198 |
| 2,503,218 | A * | 4/1950 | Rundquist | 177/194 |
| 2,582,017 | A * | 1/1952 | Eagle | 177/197 |
| 3,176,509 | A | 4/1965 | Schmertz | |
| 3,418,711 | A * | 12/1968 | Russell | 29/613 |
| 3,903,976 | A * | 9/1975 | Ziefle | 177/164 |
| 3,999,435 | A | 12/1976 | Siegel | |
| 4,059,999 | A | 11/1977 | Engeler et al. | |
| 4,083,418 | A * | 4/1978 | Hutchinson et al. | 177/247 |
| 4,712,423 | A | 12/1987 | Siffert et al. | |
| 4,980,675 | A | 12/1990 | Meisenheimer, Jr. | |
| 6,807,875 | B2 | 10/2004 | Lebrun et al. | |
| 7,054,011 | B2 | 5/2006 | Zhu et al. | |
| 7,229,208 | B2 * | 6/2007 | Verardo et al. | 368/175 |
| 7,503,688 | B2 * | 3/2009 | Hessler et al. | 368/169 |
| 7,641,381 | B2 * | 1/2010 | Levingston | 368/127 |
| 7,966,887 | B2 * | 6/2011 | Knobloch et al. | 73/705 |
| 7,969,150 | B2 * | 6/2011 | Castillo et al. | 324/303 |
| 8,157,789 | B2 * | 4/2012 | Leo et al. | 604/523 |
| 8,425,110 | B2 * | 4/2013 | Zaugg et al. | 368/177 |
| 2008/0271533 | A1 | 11/2008 | Csutak | |
| 2009/0044618 | A1 | 2/2009 | DiFoggio et al. | |
| 2009/0114013 | A1 | 5/2009 | DiFoggio | |

* cited by examiner

*Primary Examiner* — Lisa Caputo
*Assistant Examiner* — Octavia Davis-Hollington
(74) *Attorney, Agent, or Firm* — Mossman Kumar & Tyler PC

(57) ABSTRACT

An apparatus and method for estimating a parameter of interest using a force responsive element comprising, at least in part, a balanced material. The balanced material is temperature insensitive over a specified range of temperatures such that the force responsive element may estimate the parameter of interest by responding to a desired force with relatively little interference due to temperature changes within the specified range of temperatures.

15 Claims, 3 Drawing Sheets

TEMPERATURE INSENSITIVE DEVICES AND METHODS FOR MAKING SAME

CROSS-REFERENCES TO RELATED APPLICATIONS

This application claims priority from U.S. Provisional Patent Application No. 61/258,895 filed on 6 Nov. 2009.

BACKGROUND OF THE DISCLOSURE

1. Field of the Disclosure

In one aspect, this disclosure generally relates methods and apparatuses for minimizing the influence of thermal conditions on devices, including, but not limited to, devices that measure one or more parameters of interest.

2. Background of the Art

Environmental factors may influence one or more operational and/or structural aspects of a given device. The quantity or variance of thermal energy to which such a device is exposed is one such environmental factor. For instance, the relatively "hot" environment below the earth's surface (e.g., greater than about 120 Celsius) as well as the relatively "cold" environments in the Arctic (e.g., less than about zero degrees Celsius (32 degrees Fahrenheit)) may impair the performance or integrity of a device. Moreover, variances in the level of ambient thermal energy may also undesirably impact performance and/or integrity. One illustrative, but not exhaustive, impact of thermal conditions may be a change in a shape, volume, dimension or other structural aspect of a device or one or more components making up a device. The present disclosure addresses the need to minimize the impact of environmental conditions on the performance or structure of devices.

SUMMARY OF THE DISCLOSURE

In aspects, the present disclosure is related to an apparatus and method for estimating a property of interest using a measuring device that includes a balanced material. The balanced material allows the measurement device to operate over a range of temperatures with reduced sensitivity to thermal changes.

One embodiment according to the present disclosure includes an apparatus, comprising: a force responsive element, wherein the force responsive element at least partially includes a balanced material.

Another embodiment according to the present disclosure includes a method for estimating a parameter of interest, comprising: estimating a parameter of interest using a device in operable communication with the parameter of interest, the device including a force responsive element that includes a balanced material.

Another embodiment according to the present disclosure includes an apparatus, comprising: a force responsive element, wherein the force responsive element at least partially includes a balanced material that is temperature insensitive over a specified range of temperatures; and a measurement device associated with the force responsive element, wherein the measurement device measures an amount of displacement in the force responsive element.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Figure 1:
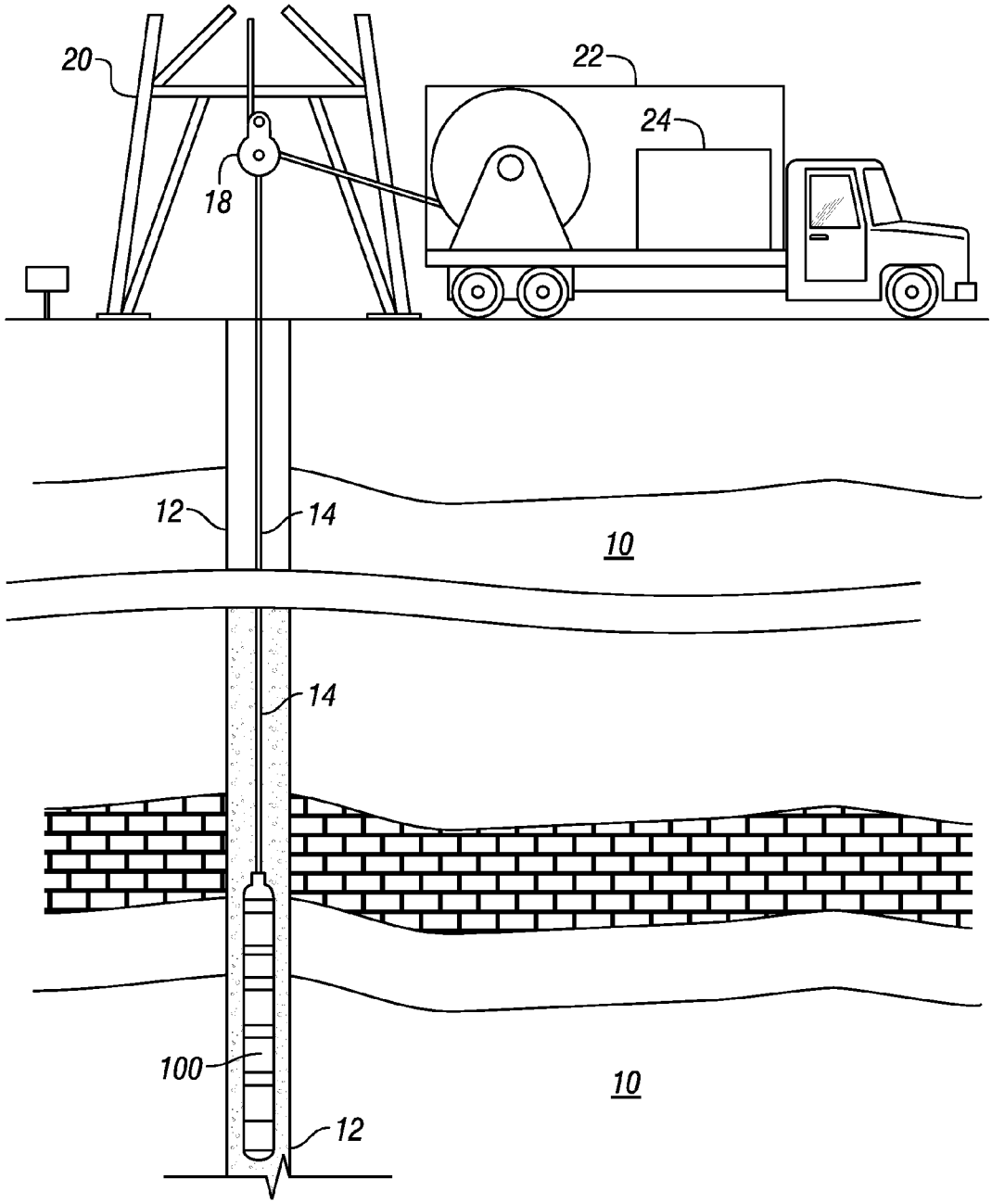
FIG. 1 shows a measurement device deployed along a wireline according to one embodiment of the present disclosure.

The present disclosure relates to devices and methods for controlling the influence of thermal energy on one or more devices. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

One illustrative device that may be sensitive to thermal loadings is a device that uses one or more force responsive elements. The device may be used for estimating or measuring a force. As used herein, a force responsive element is an element, such as a spring, that exhibits or demonstrates a change of condition, such as bending, generating an electric charge, generating a magnetic field, deforming, distorting, or displacing, when exposed to an external force or torque. Force responsive elements include, but are not limited to, springs, cantilevers, piezoelectric crystals, and wires. In practice, force responsive elements are often comprised of an elastic solid. Internal forces and torques that are caused by the external force or torque are the mechanisms for restoring the force responsive element to its original shape. For small distortions, these forces and torques may be proportional to the distortion.

In the area of micro-electro-mechanical systems (MEMS) devices, the simple cantilever beam, or some variation thereof, is a type of force responsive element that is commonly used. This disclosure uses a simple cantilever for illustration and example only, as it would be apparent to one ordinary skill in the art that this disclosure could be used for a variety of types of force responsive elements.

Many technologies used to measure acceleration may depend on force responsive elements. Herein, acceleration may be due to a change in velocity, gravitational force, or other induced forces. In these technologies, displacement from equilibrium of a proof-mass attached to a mechanical force responsive element may be measured. While the displacement can be measured in many ways, a typical feature is the proof-mass attached to a spring or cantilever.

The temperature dependence of spring characteristics may be of particular importance for precision measurements. The thermal coefficient of expansion, $\alpha_L$, for spring materials is usually between a few parts per million per degree Celsius (ppm/° C.) to as large as several hundred ppm/° C. Simple changes in the dimensions of a spring may cause changes to the bias (equilibrium position) as well as the spring constant. The elastic constant of spring materials, $\alpha_E$, is, in general, even more temperature sensitive and may cause correspondingly larger changes in the bias and spring constant.

When these thermal coefficients are compared to the requirement for accuracy of 1 to 10 parts per billion (ppb), it is desirable to mitigate the temperature effects in precision measurement instruments in order to achieve improved accuracy over a range of temperatures. One common method used to mitigate temperature effects on a force responsive element is to regulate the temperature of the device. However, the mitigation of temperature effects may be insufficient, impractical, or impossible depending on the circumstances for that particular device. One embodiment of this disclosure relates to methods and apparatuses to minimize the thermal effects on a force responsive element that may be used on proof-mass displacement in precision devices such as, but not limited to, gravimeters and accelerometers.

An illustrative methodology of the present disclosure is that thermal effects may be minimized according to the expression:

$$(\alpha_E+\alpha_L)\approx 0 \quad (1),$$

where $\alpha_E$ is the thermal coefficient of elasticity and the $\alpha_L$ is the thermal coefficient of expansion for the force responsive element. A material with thermal coefficients that substantially satisfies eqn. 1 is a balanced material, since the thermal coefficients balance near or at the value of zero. Thus, in a balanced material, over a specified temperature range, the thermal coefficient of expansion may nearly or completely offset the thermal coefficient of elasticity.

One type of force responsive element that could be used in a precision measurement instrument is a simple cantilever beam. The beam may be rigidly attached to a structure and may be allowed to bend because of its own weight or by some force that is applied at its free end. For example, one could attach a mass to the free end to increase the deflection of the free end due to gravity or some other acceleration. If a force is applied to the free end of a simple cantilever, the spring constant of the cantilever k will be such that:

$$k^{-1} = \frac{4L^3}{Yt^3w} + \frac{L}{ntw} \quad (2)$$

Where t is thickness, w is width, and L is length, Y is the Young's Modulus for the cantilever, and n is Poisson's ratio.

The second term in eqn. (2) may be ignored. We allow the length, width, and thickness to vary with temperature and have thermal coefficient of expansion, $\alpha_L$. The elastic or Young's modulus has thermal coefficient of $\alpha_E$. Herein, T is the temperature and the subscript 0 means that the quantity has that value at $T_0$.

$$Y=Y_0(1+\alpha_E\Delta T);$$

$$x=x_0(1+\alpha_L\Delta T);\ x\in\{L,t,w\};$$

$$x(T_0)=x_0;$$

$$\Delta T=T-T_0 \quad (3)$$

With the addition of the thermal coefficients, eqn. (2) becomes $$k^{-1} = \frac{4(L_0(1+\alpha_L\Delta T))^3}{(Y_0(1+\alpha_E\Delta T))(t_0(1+\alpha_L\Delta T))^3(w_0(1+\alpha_L\Delta T))} \quad (4)$$

$$k^{-1} = \frac{4L_0^3}{Y_0t_0^3w_0} * \frac{1}{((1+\alpha_E\Delta T)(1+\alpha_L\Delta T))} = k_0^{-1}\frac{1}{(1+\alpha_E\Delta T)(1+\alpha_L\Delta T)}$$

Keeping only the first order terms.

$$k^{-1} \approx k_0^{-1}\frac{1}{(1+(\alpha_E+\alpha_L)\Delta T} \quad (5)$$

Using the well known expansion $$\frac{1}{1+x} = 1 - x + x^2 - x^3 + \ldots\ , \quad (6)$$

And keeping only the first order terms $$k^{-1}\approx k_0^{-1}(1-(\alpha_E+\alpha_L)\Delta T) \quad (7)$$

Thus, the thermal coefficient for the cantilever is:

$$\alpha^{k^{-1}}=-(\alpha_E+\alpha_L) \quad (8)$$

Constructing a force responsive element out of at least one balanced material such that $\alpha_{k^{-1}}=0$ may make the spring temperature insensitive to the first order over a desired temperature range.

The spring constant k of the cantilever varies proportionally with two thermal coefficients, which typically vary in opposite directions. Most materials generally expand with increasing temperature so $\alpha_L>0$, and most materials get weaker with increasing temperature so $\alpha_E<0$. Thus, the combination of the two thermal coefficients for a material may satisfy $(\alpha_E+\alpha_L)\approx 0$ (1), if the two thermal coefficients, over a range of temperatures, are approximately equal and opposite relative to zero.

Equation (1) may be satisfied if the combination of the two thermal coefficients is substantially zero. Herein, a combination of the two thermal coefficients is substantially zero when the resulting temperature insensitivity is such that spring constant k varies by about 10 ppb or less over a desired range of temperature when a constant force is applied.

While many materials may have $\alpha_E$ values of about −100 ppm, while having $\alpha_L$ values on the order of a few ppm, a balanced material has a combined $\alpha_E$ and $\alpha_L$ value of about zero. A balanced material may be balanced over a specific temperature range. Exemplary balanced materials may be obtained from Ed Fagan, Inc. and Special Metal Corporation. For example, when using a balanced material C, the sum in eqn. (1) is about zero just above room temperature. This means that balanced material C in this example may serve as a balanced material for a device used at room temperature. However, other materials may be required for devices that operate at different temperatures, such as down a wellbore, inside an oven, in a volcano, or subsea. The materials used and their tolerances may vary depending on environmental conditions, intended uses, and desired performance as understood by one of ordinary skill in the art.

Figure 2:
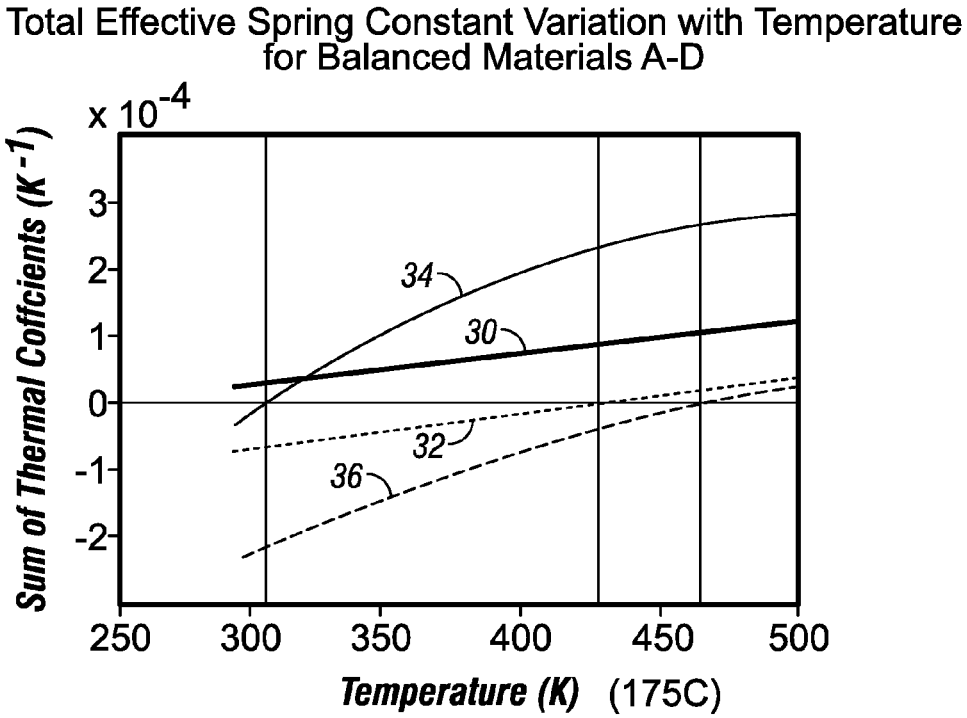
FIG. 2 shows a temperature graph of a series of balanced materials according to the present disclosure.

Referring now to FIG. 2, there are shown curves 30, 32, 34, 36 representative of the sum of the thermal coefficient of elasticity and the coefficient of thermal expansion for balanced materials A-D that have characteristics of a balanced material in certain temperature ranges. Curves 30, 32, 34, 36 represents the sum of the thermal coefficient of elasticity and the coefficient of thermal expansion for balanced materials A-D, respectively. For balanced materials A-C, curves 32, 34, 36, the sum goes to zero between room temperature (300 degrees Kelvin (80 degrees Fahrenheit)) and 500 degrees Kelvin (440 degrees Fahrenheit). While some embodiments are discussed in terms of balanced materials that occur at relatively high temperatures, this is illustrative and exemplary only. One of skill in the art will appreciate that embodiments of this disclosure may be used over a wide range of temperatures, including with force responsive elements comprising materials that are balanced materials at below zero degrees Celsius (32 degrees Fahrenheit) or above 120 degrees Celsius (248 degrees Fahrenheit). The balanced materials A-D may include one or more of the following materials: iron, nickel, cobalt, aluminum, niobium, titanium, sulfur, carbon, silicon, and chromium. The amount of the material or materials may range from trace amounts (e.g. 0.04 percent) to 40 percent or greater. However, balanced materials A-D are illustrative and exemplary only, as other materials may be used to satisfy eqn. (1) as understood by those of skill in the art. This disclosure includes, but is not limited to, materials that are metals and non-metals. Balanced materials may be crystalline or amorphous in form. Balanced materials may include alloys, polymers, and other combinations of elements.

Figure 3:
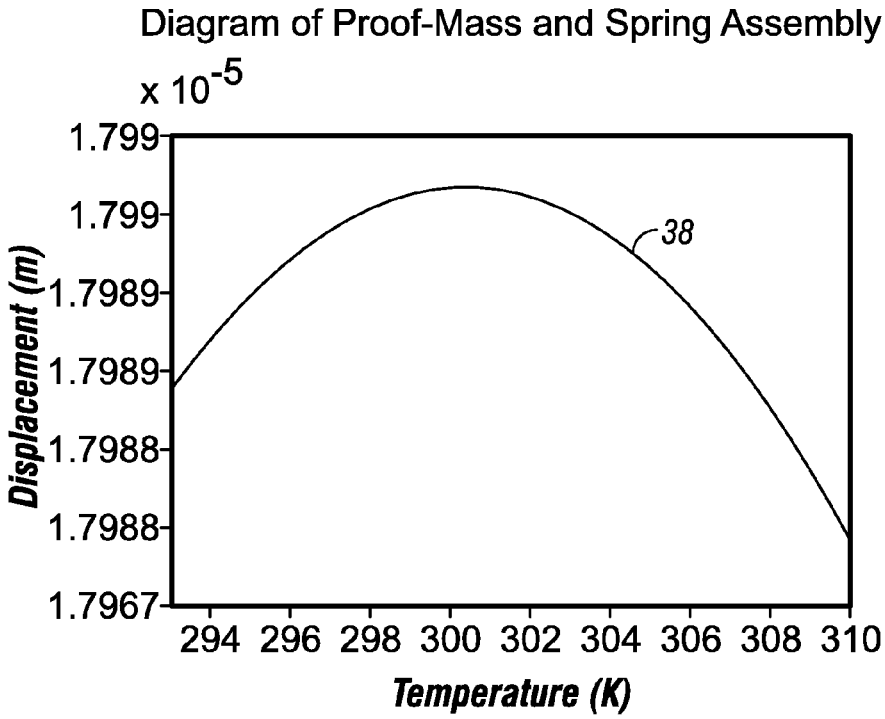
FIG. 3 shows the displacement of a force responsive element over a range of temperatures with constant force applied.

FIG. 3 shows a curve 38 of the displacement of a force responsive element comprising balanced material C and with a proof-mass over a range of temperatures. The displacement of the proof-mass was modeled as a function of temperature. Herein, the displacement of the proof-mass as a function of temperature is shown when a gravitational acceleration of 1 g is applied.

The displacement of the proof-mass reaches a maximum at a temperature between 300 degrees Kelvin (80 degrees Fahrenheit) and 302 degrees Kelvin (84 degrees Fahrenheit). The temperature dependence of the displacement is approximately parabolic around this maximum. This illustrates that the proof-mass and spring assembly are independent of the first order temperature coefficients in this temperature range.

FIG. 1 shows one embodiment according to the present disclosure wherein a cross-section of a subterranean formation 10 in which is drilled a borehole 12 is schematically represented. Suspended within the borehole 12 at the bottom end of a non-rigid carrier such as a wireline 14 is a device or tool 100. The wireline 14 may be carried over a pulley 18 supported by a derrick 20. Wireline deployment and retrieval is performed by a powered winch carried by a service truck 22, for example. A control panel 24 interconnected to the tool 100 through the wireline 14 by conventional means controls transmission of electrical power, data/command signals, and also provides control over operation of the components in the device 100. In some embodiments, the borehole 12 may be utilized to recover hydrocarbons. In other embodiments, the borehole 12 may be used for geothermal applications or other uses.

In embodiments, the device 100 may be configured to actively or passively collect data about the various characteristics of the formation, provide information about tool orientation and direction of movement, provide information about the characteristics of the reservoir fluid and/or to evaluate reservoir conditions (e.g., formation pressure, wellbore pressure, temperature, etc.). Exemplary devices may include resistivity sensors (for determining the formation resistivity, dielectric constant and the presence or absence of hydrocarbons), acoustic sensors (for determining the acoustic porosity of the formation and the bed boundary in the formation), nuclear sensors (for determining the formation density, nuclear porosity and certain rock characteristics), and nuclear magnetic resonance sensors (for determining the porosity and other petrophysical characteristics of the formation). Other exemplary devices may include accelerometers, gyroscopes, gravimeters and/or magnetometers. Still other exemplary devices include sensors that collect formation fluid samples and determine the properties of the formation fluid, which include physical properties and chemical properties.

Device 100 may be conveyed to move device 100 to a position in operable communication or proximity with a parameter of interest. In some embodiments, device 100 maybe conveyed into a borehole 12. The parameter of interest may include, but is not limited to, acceleration. Depending on the operating principle of the device 100, the device 100 may utilize one or more force responsive elements. The ambient temperature in the wellbore may exceed 120 degrees Celsius (248 degrees Fahrenheit) and may otherwise undesirable affect the behavior of the force responsive element to an applied force.

Figure 4:
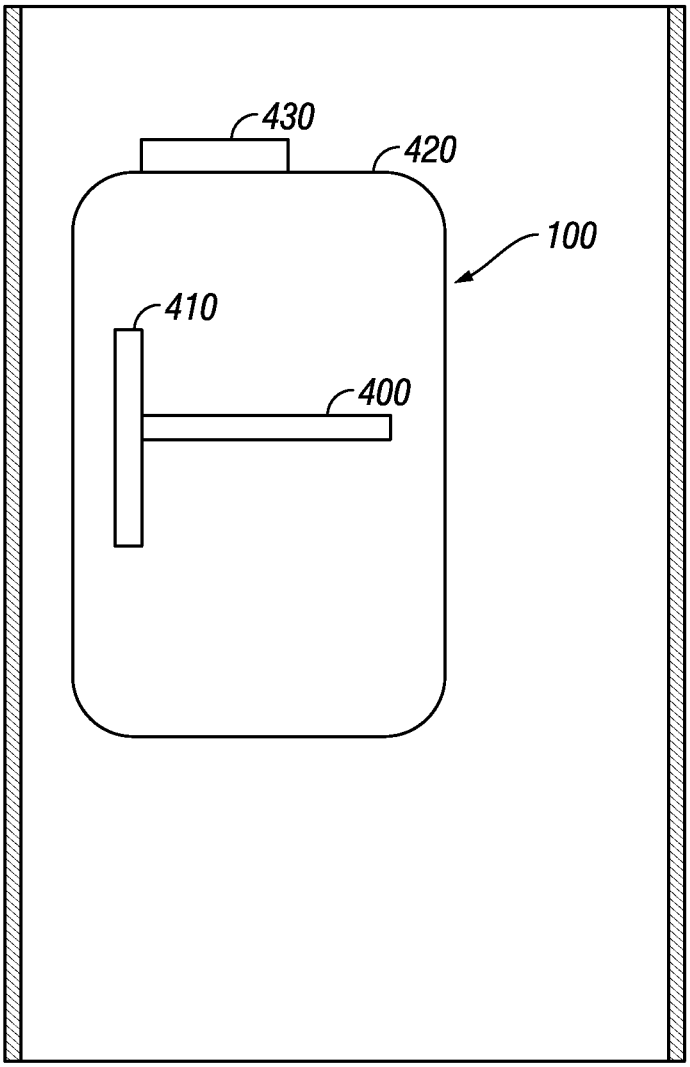
FIG. 4 shows a measurement device according to one embodiment of the present disclosure.

In other embodiments, a device utilizing one or more force responsive elements may be used at the surface 160. As shown in FIG. 4, in one embodiment, the device 100 may include a cantilever 400 attached to a measurement unit 410 for detecting the change in condition of the cantilever 400. Exemplary changes of condition may include bending, generating an electric charge, generating a magnetic field, deforming, distorting, displacing, etc. Cantilever 400 may be enclosed in a protective container 420 to protect it from vibration or energy sources. Optionally, a temperature regulation device 430 may be used to regulate the temperature within the protective container 420 to provide a stable operating environment (such as provide a predetermined temperature range) for the cantilever and/or measurement unit 410.

One embodiment according to the present disclosure includes an apparatus, comprising: a force responsive element, wherein the force responsive element at least partially includes a balanced material that is temperature insensitive over a specified range of temperatures at least 0.10 degrees Celsius (0.18 degrees Fahrenheit) wide, and wherein temperature insensitivity comprises a variation of at most $10^{-8}$ times the gravitational acceleration of the earth over the specified range of temperatures; and a measurement device associated with the force responsive element, wherein the measurement device measures an amount of displacement in the force responsive element. The range of temperatures is not limited to at least 0.10 degrees Celsius (0.18 degrees Fahrenheit) and may be selected as desired or necessary for the desired application of the apparatus. In some embodiments, a larger or smaller range than 0.10 degrees Celsius (0.18 degrees Fahrenheit) may be used. Additionally, the range of temperature insensitivity is not limited to at most $10^{-8}$ times the gravitational acceleration of the earth over the specified range of temperatures, as the desired application of the apparatus may require a greater or smaller range of temperature insensitivity.

Another embodiment according to the present disclosure includes a method for estimating a parameter of interest, comprising: disposing a measurement device in operable communication with the parameter of interest, the measurement device including a force responsive element that includes a balanced material, wherein the force responsive element is temperature insensitive over a specified range of temperatures at least 0.10 degrees Celsius (0.18 degrees Fahrenheit) wide, and wherein insensitivity to temperature comprises a variation of at most $10^{-8}$ times the gravitational acceleration of the earth over the specified range of temperatures;

and estimating the parameter of interest using the measurement device. The range of temperatures is not limited to at least 0.10 degrees Celsius (0.18 degrees Fahrenheit) and may be selected as desired or necessary for the desired application of the method. In some embodiments, a larger or smaller range than 0.10 degrees Celsius (0.18 degrees Fahrenheit) may be used. Additionally, the range of temperature insensitivity is not limited to at most $10^{-8}$ times the gravitational acceleration of the earth over the specified range of temperatures, as the desired application of the method may require a greater or smaller range of temperature insensitivity.

While the disclosure has been described with reference to exemplary embodiments, it will be understood that various changes may be made and equivalents may be substituted for elements thereof without departing from the scope of the disclosure. In addition, many modifications will be appreciated to adapt a particular instrument, situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

While the foregoing disclosure is directed to the one mode embodiments of the disclosure, various modifications will be apparent to those skilled in the art. It is intended that all variations within the scope of the appended claims be embraced by the foregoing disclosure.

We claim:

1. An apparatus, comprising:

a measurement device including a force responsive element, wherein the force responsive element at least partially includes a balanced material, wherein the balanced material has a thermal coefficient of expansion and a thermal coefficient of elasticity that sum to substantially zero.

2. The apparatus of claim 1, wherein the measurement device measures an amount of displacement in the force responsive element.

3. The apparatus of claim 1, wherein the force responsive element is temperature insensitive over a specified range of temperatures.

4. The apparatus of claim 3, wherein the specified range of temperatures is at least 0.1 degrees Centigrade wide.

5. The apparatus of claim 3, wherein the lower end of the specified range of temperatures exceeds 120 degrees Centigrade.

6. The apparatus of claim 3, wherein insensitivity to temperature comprises a variation of at most $10^{-8}$ times the gravitational acceleration of the earth over the specified range of temperatures.

7. The apparatus of claim 1, wherein the balanced material has a thermal coefficient of expansion that offsets a thermal coefficient of elasticity.

8. A method for estimating a parameter of interest, comprising:

estimating the parameter of interest using a measurement device disposed in operable communication with the parameter of interest, the measurement device including a force responsive element that includes a balanced material, wherein the balanced material has a thermal coefficient of expansion and a thermal coefficient of elasticity that sum to substantially zero.

9. The method of claim 8, wherein the force responsive element is temperature insensitive over a specified range of temperatures.

10. The method of claim 9, wherein the specified range of temperatures is at least 0.1 degrees Centigrade wide.

11. The method of claim 9, wherein the lower end of the specified range of temperatures exceeds 120 degrees Centigrade.

12. The method of claim 9, wherein insensitivity to temperature comprises a variation of at most $10^{-8}$ times the gravitational acceleration of the earth over the specified range of temperatures.

13. The method of claim 8, further comprising:

conveying the measurement device to a position in operable communication with the parameter of interest.

14. The method of claim 8, wherein the parameter of interest comprises acceleration.

15. The method of claim 8, wherein the balanced material has a thermal coefficient of expansion that offsets a thermal coefficient of elasticity.

* * * * *